United States Patent [19]

Dubach

[11] Patent Number: 4,921,113

[45] Date of Patent: May 1, 1990

[54] SNAP CLOSURE WITH ORIGINAL SEAL SAFETY

[75] Inventor: Werner F. Dubach, Maur, Switzerland

[73] Assignee: Alfatechnic AG, Switzerland

[21] Appl. No.: 289,955

[22] Filed: Dec. 22, 1988

[30] Foreign Application Priority Data

Dec. 22, 1987 [AT] Austria ..... 3398/87

[51] Int. Cl.[5] ..... B65D 41/46

[52] U.S. Cl. ..... 215/253; 215/305; 215/237; 215/304

[58] Field of Search ..... 215/253, 225, 241, 237, 215/251, 304, 305, 336

[56] References Cited

U.S. PATENT DOCUMENTS

| | | | |
|---|---|---|---|
| 801,282 | 10/1905 | Weissenthanner | 215/305 X |
| 3,382,997 | 5/1968 | Tsuji | 215/253 |

FOREIGN PATENT DOCUMENTS

| | | | |
|---|---|---|---|
| 503298 | 6/1951 | Belgium | 215/305 |
| 1270434 | 5/1968 | Fed. Rep. of Germany . | |
| 1432225 | 6/1969 | Fed. Rep. of Germany . | |
| 1607863 | 8/1970 | Fed. Rep. of Germany . | |
| 1430724 | 1/1966 | France | 215/305 |
| 454551 | 8/1950 | Italy | 215/305 |
| 467076 | 11/1951 | Italy | 215/305 |
| 553717 | 1/1957 | Italy | 215/253 |
| 553696 | 9/1974 | Switzerland . | |
| 561641 | 5/1975 | Switzerland . | |

*Primary Examiner*—Stephen Marcus
*Assistant Examiner*—Christine A. Peterson
*Attorney, Agent, or Firm*—Thomas W. Speckman; Douglas H. Pauley

[57] ABSTRACT

A snap closure with original seal safety is particularly suited for bottles with bulging rim areas on the bottle neck. The original safety sealing takes place by means of a release element, which comprises a pressing element which is bounded on both sides by weak points. The release element forms a portion of the circumferential wall. In order that the release element not be torn further than desired, the weak points proceeding in the axial direction of the closure reach only into the area of an annular bulge positioned on the internal surface of the circumferential wall. The release element itself, which has at least one corrugation, is connected with the circumferential wall by means of a film hinge, and can pivot by 90 degrees upon destruction of the weak points.

5 Claims, 1 Drawing Sheet

FIG.1
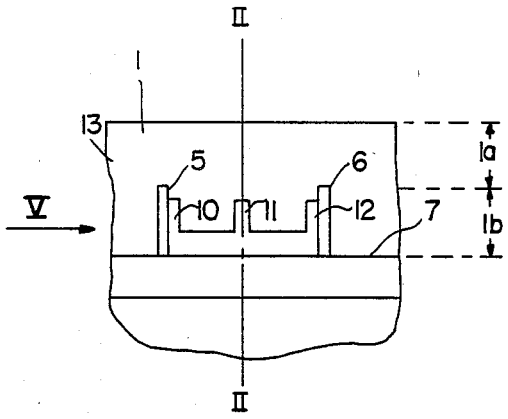
FIG.2
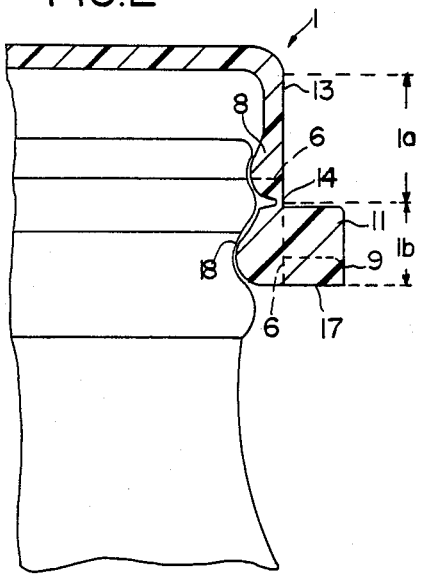
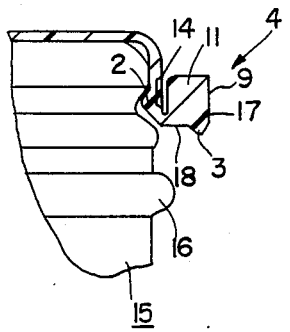
FIG.3
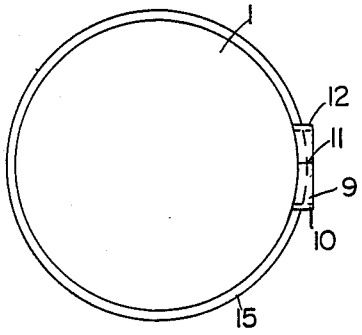
FIG.4
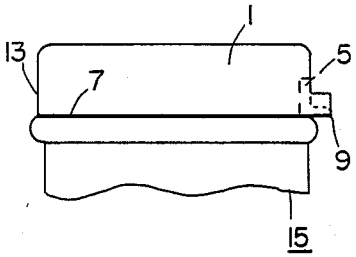
FIG.5

SNAP CLOSURE WITH ORIGINAL SEAL SAFETY

BACKGROUND OF THE INVENTION

1. Field of the Invention

This invention relates to a snap closure with original seal safety for containers, especially bottles with outwardly bulging rim areas, whereby the closure has a circumferential wall projecting from the closure base, which has at least one annular area with snap projections which project inwardly in a bulge-like manner, and a circumferential wall section of the closure is formed by a release element which is laterally bounded by weak points which proceed from the free edge of the circumferential wall.

2. Description of the Prior Art

Seals are known which have a threaded plug (sealing cone) projecting from the closure bottom, which threaded plug serves for sealing in a manner analogous to a stopper. It is presumed that the threaded plugs are to be used for traditionally produced packagings, and that the bottle aperture is produced within narrow tolerances. This is not, however, suitable for glass bottles. Only in the rarest of cases do the known seals provide a firm sealing during re-use after a first opening. If they do provide a sealing, they permit no reduction of the internal pressure, since the threaded plug is then firmly seated in the interior of the neck of the bottle.

From German Patent Publication DE-OS 16 07 863, it is known to position projections, in the interior of the circumferential wall of the closure, in two annular areas spaced axially from one another. This closure likewise has a tearing strip, which, upon tearing open, tears through a lower annular area. As a consequence of a plug which is also present in this closure, with a correct positioning of the threaded plug in the neck of this container, a reduction of excess pressure from the interior of the container cannot take place.

The known seals are additionally provided with a pull element, generally with a tear-off strip. During every reuse, a considerable notching effect is exerted, which makes repeated reuse doubtful. If such a strip is only stressed to pressure, by rotating the strip by 90 degrees, and there is no more working surface in the direction of the opening movement, that is to say, in the axial direction of the bottle neck.

SUMMARY OF THE INVENTION

By means of this invention, a snap closure is now created which avoids the disadvantages stated above. Through this means, an original seal safety should be attained, without components of the original safety seal remaining hanging on the bottle neck after the first opening. The means for the original safety seal should, not form any discard part, Furthermore, the closure should ensure that gasses which form in the interior of the container can escape, whereby a sufficient sealing during the reuse of the sealing cover can be ensured after the first opening.

For such types of seals, fluid tightness, tightness against underpressure, favorable price and the possibility of tight resealing are further requirements.

Furthermore, the closure should also be able to be processed during a recycling process. This is attained in a snap closure of the type stated above, if both the break points laterally bounding the release element penetrate the lower circumferential wall area in its entirety and an annular area only in part, and that the release element has a pressing element projecting at least roughly vertically from the circumferential wall of the cover, which pressing element, by means of a film hinge, is connected in a pivotable manner below the said annular area.

For the opening of the snap closure, the release element is pressed upwardly, by which the element is separated from the circumferential wall of the snap closure along the break points, and now remains connected with the circumferential wall by means of the film hinge. Through the further upward pressing of the release element, the lower closure area is first of all completely cut through, and loses its circumferential tension. The snap closure can in such a manner then be released from the bottle neck. The tension in the remaining annular area is reduced, since the break points laterally bounding the release element extend into this annular area. The design in accordance with the invention thus ensures an easy removal of the snap closure. However, since not every annular area is completely separated, a circumferential expansion is made difficult in this area, so that, by means of the projections which grip below a protrusion on the neck of the bottle, and are positioned in the upper annular area, a sufficient pull is exerted on the circumferential wall of the closure, in order to press and to seal the closure base against the outer surface of the container. Upon the appearance of internal excess pressure, the closure base bulges, through which fact the tension on the frontal surface is reduced, and the internal pressure can be reduced. Due to the necessary deformation of the pressing element during tearing, the consumer can see whether the snap closure is still in its original condition or if it has already been damaged. Upon a new replacement of the snap closure, a further tearing is not to be feared at the break points, because, during the molding process, an orientation of the molecular chains appears at the break points, resulting in a high tensile strength.

In one embodiment of the snap closure in accordance with the invention, it is provided that both the break points laterally bounding the release element are conducted up to the center of the remaining annular area.

In another embodiment of the snap closure in accordance with the invention, that the release element has a pressing element projecting from the circumferential wall of the cover, which pressing element is provided with at least one rib, which extends up to the area of the film hinge connecting the release element with the circumferential wall of the closure. This embodiment of the snap closure makes it possible, after pressing upwardly, to pivot the pressing element upwardly about the film hinge by approximately 90 degrees, far enough until at least one rib comes to contact on the circumferential wall lying above the film hinge. By means of the pressing element, through exerting a force in the axial direction of the closure, a force can then be exerted, through which the projections of the remaining annular area in the area of the release element are moved over the bulge on the container neck, by which action the closure can be opened.

In order to favorably initiate force upon the closure, in one embodiment of the snap closure in accordance with the invention, the pressing element can have three ribs, whereby two ribs are positioned on the lateral edge adjacent to the weak points, and the third rib is positioned between the two above-stated ribs.

BRIEF DESCRIPTION OF THE DRAWING

The invention will now be illustrated in further detail by means of the drawing wherein:

FIG. 1: A frontal view of a snap closure seal constructed in accordance with the invention and mounted on a bottle neck, in the area of the release element;

FIG. 2: A partial sectional view along the line II—II in FIG. 1;

FIG. 3: A partial sectional view corresponding to FIG. 2, the snap cover closure in a position after the release of the release element;

FIG. 4: A top view of the closure depicted in FIG. 1, rotated 90 degrees relative to the representation in FIG. 1; and FIG. 5: A side view of a bottle neck provided with a closure in accordance with the invention, in the direction of the arrow (V) in FIG. 1.

DESCRIPTION OF PREFERRED EMBODIMENTS

In the drawings, the snap closure cover is designated by (1). As shown in FIG. 2 two axially-spaced annular areas (1*a* and 1*b*) with projections (2 and 3) projecting inwardly in a protruding manner. These projections can form a circular annular bulge; however, individual projections can also be provided in the circumferential direction spaced from one another in these annular areas. It is also possible to provide one annular area with a circumferential annular bulge and the other annular area with individual projections in a protruding construction.

The closure cover (1) furthermore has a release element (4) which forms a section of the circumferential wall of the closure. The release element (4) is laterally bounded by break points (5 and 6). These break points extend from the lower edge (7) of the cover (1), and are conducted over the lower annular area (1*b*). The weak points (5 and 6) end at a lower point than the end of the annular area (1*a*) on the cover side. In the example of execution depicted, the break points (5 and 6) are positioned in the axial direction of the closure, thus, in parallel to one another. Upon release of the release element (4), the lower annular area, extending from the lower edge (7) of the cover (1), is cut through in the manner of a shearing movement, by which the lower annular area, or the annular bulge located there, loses its force against the bottle neck (15). The tearing of the break points on both sides of the release element (4) is achieved through the notching effect of the break points (5 and 6). The break points (5 and 6) end at a lower point than at the end (8) of the upper annular area (la) on the cover side. Through this means, in the upper annular area, a certain circumferential tension is maintained. This circumferential tension can be reduced through the fact that the break points are conducted into the upper annular area (1*a*), preferably up to approximately the center of the upper annular area (1*a*). Such an embodiment is, for example, evident in FIG. 2.

If the tension in the upper annular area is reduced, a slight lifting of the cover closure from the bottle neck (15) is possible, however, enough tension remains so that the tightness of the cover can be ensured during repeated closings.

The release element (4) has a pressing element (9) projecting from the circumferential wall of the cover (1), which pressing element is provided with at least one, but preferably three, ribs (10, 11 and 12). These ribs extend into the area of the film hinge (14) connecting the release element (4) with the circumferential wall (13) of the snap closure. If, after the destruction of the break points (5 and 6), the film hinge (14) is pivoted upwardly by 90 degrees, the ribs (10, 11 and 12) come to be applied against the outer surface of the cover (1), so that exertion of a further pressure in an upward direction, through the lever effect, ensures that a lifting of the closure cover (1) from the bottle neck is attained.

During the rotational movement of the pressing element (9), the original pressure surface (17), which was directed downwardly in the initial position, moves outwardly and moves the surface (18) directed inwardly, which was directed toward the bottle neck (15), in a downward direction, and thus forms a new pressing surface (18), on which a force can be exerted in the axial direction.

Since, upon a first-time opening of the snap cover closure, the pressing element (9) is deformed and remains attached to the cover; in the manner of an externally-directed flap, it is immediately evident to the consumer that the original seal is no longer provided. The bottle neck (15) is constructed so that the closure cover (1) comes, with its lower edge to contact on a bulge (16) of the bottle neck, so that one cannot put his hand under the closure cover (1) without the use of a special tool. A lifting of the closure cover (1) can thus only take place by means of the release element.

Instead of the ribs (10, 11 and 12), a penetrating bar can also be present, the upper edge of which lies in the area of the film hinge, and projects approximately perpendicularly from the circumferential wall (13).

I claim:

1. A snap closure with an original seal safety for containers, particularly for bottles with outwardly bulging rim areas, said snap closure comprising a circumferential wall (13) projecting around a circumference of said snap closure (1), said circumferential wall (13) having at least one annular area with a first snap projection (3) and a second snap projection (2) projecting inwardly in a protruding manner and a release element (4) pivotably attached to an exterior surface of said circumferential wall (13) and bounded laterally by break points (5, 6) which extend from a free edge of said circumferential wall (13), both said break points (5, 6) laterally bounding said release element (4) penetrating a lower annular area (1*b*) with said first snap projection (3) in its entirety and an upper annular area (1*a*) with said second snap projection (2) partially, said release element (4) having a pressing element (9) projecting generally vertically from said circumferential wall (13), said pressing element (9) pivotally connected to said circumferential wall (13) with a film hinge (14) beneath said upper annular area (1*a*).

2. A snap closure in accordance with claim 1 wherein both said break points (5, 6) laterally bounding said release element (4) extend up to about a center of said second snap projection (2) of said upper annular area (1*a*).

3. A snap closure in accordance with claim 1 wherein said pressing element (9) comprises at least one rib (10, 11, 12) which extends up to said film hinge (14), so that upon exerting force on said pressing element (9), said break points (5, 6) are broken, and said pressing element (9) pivots approximately 90 degrees about said film hinge (14), and an upper side of each said rib (10, 11, 12) contacts said circumferential wall (13), whereby an internal surface of said release element (4) pivots outwardly and forms a pressing surface (18) of said release element (4) on which pressure can be exerted in an axial direction of said snap closure.

4. A snap closure in accordance with claim 3 wherein said release element (4) has three inwardly extending said ribs (10, 11, 12) comprising a first said rib (10) and a second said rib (11) positioned on a lateral edge adjacent said break points (5, 6) and a third said rib (11) is centrally positioned between said first said rib (10) and said second said rib (11).

5. A snap closure in accordance with claim 1 wherein said pressing element (9) has a form of a bar which extends up to said film hinge (14) and protrudes approximately perpendicularly to said circumferential wall (13).

* * * * *